US005372438A

United States Patent [19]

Chung

[11] Patent Number: 5,372,438

[45] Date of Patent: Dec. 13, 1994

[54] RE-INKING DEVICE

[76] Inventor: Seng Y. Chung, Building 290, Oxford Street, East Camp, Seletar Airport, Singapore, Singapore, 2879

[21] Appl. No.: 31,699

[22] Filed: Mar. 15, 1993

[30] Foreign Application Priority Data

Mar. 18, 1992 [GB] United Kingdom ..... 9205816

[51] Int. Cl.[5] ..... B41J 31/14

[52] U.S. Cl. ..... 400/197; 400/200; 118/235

[58] Field of Search ..... 101/332, 336; 400/197, 400/200, 202, 202.1, 202.2, 202.3, 202.4, 207, 208; 118/235, 246, 261; 427/141

[56] References Cited

U.S. PATENT DOCUMENTS

| | | | |
|---|---|---|---|
| 3,209,725 | 10/1965 | Besenick | 118/235 |
| 3,432,020 | 3/1969 | Caudill et al. | 400/234 |
| 4,068,614 | 1/1978 | Kopachkov | 118/235 |
| 4,074,811 | 2/1978 | Filak | 248/245 |
| 4,390,294 | 6/1983 | Castro | 400/202.4 |
| 4,419,956 | 12/1983 | Kwok-Fai | 118/235 |
| 4,948,275 | 8/1990 | Kuhn et al. | 400/197 |
| 5,005,997 | 4/1991 | Chung | 400/197 |

*Primary Examiner*—Ren Yan

*Attorney, Agent, or Firm*—F. Eugene Logan

[57] ABSTRACT

This invention relates to a re-inking device for multi-pass fabric ribbons or tapes wound on a spool. The device is for a fabric ribbon wound on a first spool, with means to mount the first spool to one side of a base and means to mount a second spool to the same side of the base at a position spaced from the first spool, means to connect the ribbon free end to the second spool to provide an unsupported ribbon length extending between the first and second spools, an ink reservoir mounted on the base and engageable by at least part of the unsupported ribbon length, and means to rotate the second spool relative to the base to effect winding of the ribbon from the first spool onto the second spool with concurrent ink transfer from the reservoir onto the ribbon. The invention also relates to a method of using the device for re-inking a fabric ribbon.

18 Claims, 4 Drawing Sheets

RE-INKING DEVICE

FIELD OF THE INVENTION

This invention relates to a re-inking device and method, in particular for fabric ribbons or tapes wound on a spool.

BACKGROUND TO THE INVENTION

Fabric ribbons are widely used in various office printers, such as typewriters, cash registers, telex machines and computer printers. Although some ribbons are made to be single-pass, increasingly the ribbons are made of nylon fabric or equivalent so that they can be multi-pass.

Although multi-pass ribbons have a long potential life, they become unsuited for their intended purpose if their ink content is depleted, and thus it is desirable that there be provided a device and method for re-inking such fabric ribbons, perhaps up to one hundred times, until the fabric itself becomes too worn for re-use.

DISCLOSURE OF THE PRIOR ART

A device and method for re-inking multi-pass fabric ribbons was disclosed in our international application PCT/GB89/00344. That device and method was, however, directed to fabric ribbons in the form of a continuous loop and housed in a cassette (cartridge), the cassette typically being of a plastics material. The problem there tackled was that notwithstanding that most manufacturers have their own proprietary shape and size of cassette we sought to provide a single device and method permitting re-inking not only of these currently known designs, but also future designs of a shape and size not yet known.

DISCLOSURE OF THE INVENTION

The re-inker now proposed can include components dedicated to spool re-inking, though many users will prefer to use the common parts from the commercially available embodiments according to our international application PCT/GB89/00344.

In this specification the terms "above" and "below" refer to the relative position in use.

We now propose a re-inking device for a fabric ribbon having first and second terminal ends, the ribbon being wound on a first spool with the first end innermost and the second end outermost, which includes means to mount the first spool to one side of a base, means to mount a second spool to said one side of the base at a position spaced from the first spool, means to connect the second terminal end of the ribbon to the second spool to provide an unsupported ribbon length extending between the first and second spools, ink reservoir means mounted to extend to said one side of the base and engagable by at least part of the unsupported ribbon length, and means to rotate the second spool relative to the base, to effect winding of the ribbon from the first spool onto the second spool, with concurrent ink transfer from the reservoir onto the said portion of the unsupported ribbon length. In the position of use the spools and ink reservoir will be above the base.

Conveniently, the first and second spools are supported on first and second platters mounted upon and rotatable relative to the base. Preferably the platters are movable in position relative to the base. In a preferred embodiment the first platter is held against rotation, so that the second spool has to drag the first spool around its axis (provided by an upstanding bolt shank or the like) by means of the ribbon, with first spool movement relative to the first platter and which thus provides a friction drag to tension the unsupported ribbon length as well as inhibiting over-running of the first spool.

Usefully the second platter is coupled to a drive shaft mounted to said one side of the base; in one embodiment the drive shaft can be manually rotated to rotate the second platter, but in a preferred embodiment is rotated by an electric motor, conveniently with a speed reduction, as by a pulley arrangement. Usefully, the electric motor is mounted upon the base, to extend to the said one side of the base, by means movable relative to the base so that it is adjustable in position relative to the second platter. The drive shaft is conveniently mounted upon a base adapter, of a design common to first and second base adaptors used for mounting the first and second platters.

The ink reservoir will also be mounted on and to said one side of the base so as to movable relative thereto, so that its position can be adjusted to ensure rubbing contact with at least part of the unsupported length of ribbon.

After re-inking, either the second spool can be used in the office equipment, or the ribbon can be rewound onto the first spool, and the first spool re-used in the office equipment.

In accordance with a further feature of the invention, we provide a method of re-inking a fabric ribbon, which includes the steps of connecting the free terminal ribbon end of a ribbon wound onto a first spool to a second spool spaced apart from the first spool to provide an unsupported ribbon length extending between the first and second spools, engaging at least part of the unsupported ribbon length with an ink supply, and winding the ribbon from the first spool onto the second spool whilst ink is being transferred onto the said part of the unsupported ribbon length from the ink supply. Preferably the ink supply is a reservoir orifice, which can be sealed when not in use. Preferably the free run has a non-linear portion engaging the ink reservoir i.e. the ink reservoir is in the run path directly between the two spools.

SHORT DESCRIPTION OF THE DRAWINGS

The invention will be further described, by way of example, with reference to the accompanying schematic drawings, not to scale, in which.

DESCRIPTION OF EXEMPLARY EMBODIMENTS

Figure 1:
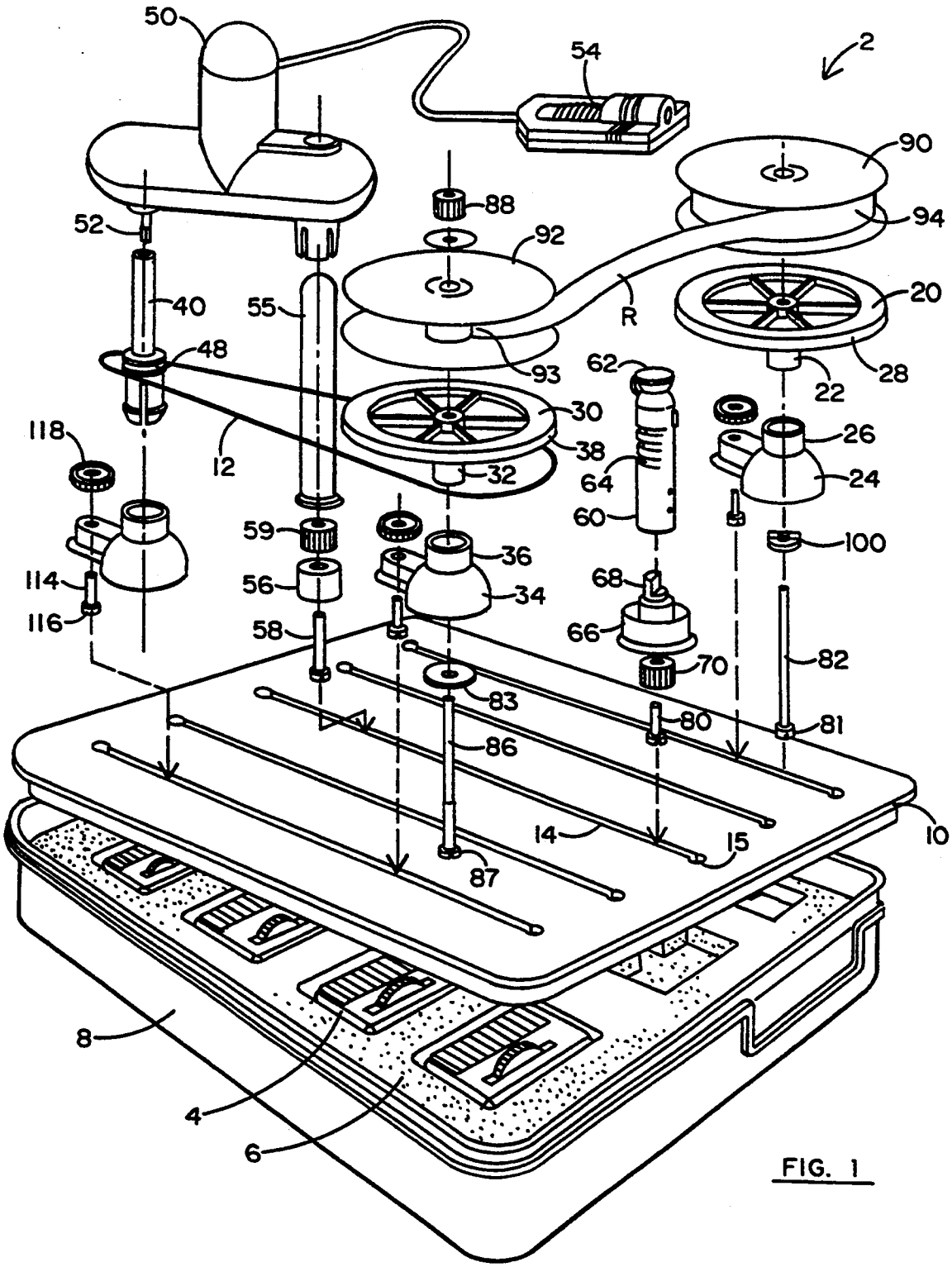
FIG. 1 is an exploded perspective view of a re-inking device for a fabric ribbon shown extending between first and second spools.

Device 2 is shown in exploded perspective view in FIG. 1.

During storage or delivery, the device components are located in respective chambers 4 in polyurethane foam 6 in a box compartment 8. The lid of the box when the device is in use, provides a mounting platform or base 10 for the components.

First and second platters 20,30 are mounted by way of downwardly extending spindles 22,32 on respective base adapters 24,34, above base 10 i.e. to one side of base 10. The base adapters have respective upwardly extending annular housing portions 26,36 which embrace spindles 22,32 (see also FIGS. 2/4).

Platters 20,30 have a brass insert 11, internally tapped and threadedly engaged with bolt 82,86 so that each platter is firmly held between bolt head 81,87 and the insert. As more fully described below, adjacent the bolt head of the first platter is a lock washer 100, whilst adjacent the second platter is a plain washer 83.

In this embodiment, both first platter 20 and second platter 30 have a respective peripheral groove 28,38, but in an alternative embodiment only the second platter 30 has such a groove.

Figure 3:
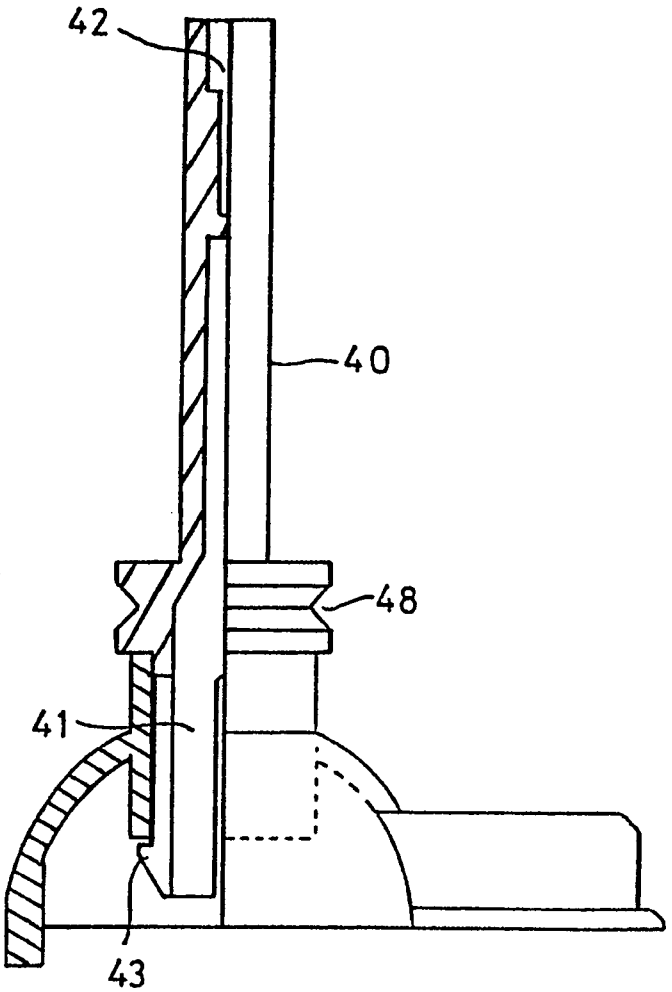
FIG. 3 is a side view, partly in section, of a drive shaft, fitted for use on a base adapter.

Fitted within groove 38 is an endless drive belt 12, which also fits within groove 48 of drive shaft 40. As seen in FIG. 3, drive shaft 40 has an acircular drive portion 42 engagable by drive member 52 of motor 50. In this embodiment, the output speed of motor 50 is 70 rpm, which is faster than is required, so that the circumference of the grooves 38,48, and belt 12 provide a pulley arrangement with a 4:1 speed reduction.

Motor 50 is controlled by on-off switch 54, but in an alternative embodiment is controlled (also) by a variable potentiometer adapted to adjust the speed of drive belt 12 in accordance with the proportion of wound ribbon on second spool 30, to maintain the longitudinal speed of unsupported ribbon length R constant or substantially so.

Motor 50 is supported upon column 55. Column 55 is hollow, and of an internal diameter at its lower end to form a friction grip with sleeve 56. Sleeve 56 is located by means of headed bolt 58 and nut 59. Headed bolt 58 projects through base 10. The bolt shank can be slid along a selected slot 14, or the bolt can be relocated in another slot, by way of an enlarged slot terminal portion 15. Thus, the motor 50 can be adjustably positioned relative to the base 10. Ink reservoir 60 has a cap 62 which is removable to allow ink flow from one or more ink orifices 64 in the side wall of the reservoir. The reservoir 60 is mounted above an annular hollow well 66 adapted to retain any surplus ink overflowing out from the orifices 64. The well 66 has an upstanding portion 68 engagable with a corresponding recessed portion (not shown) within the reservoir housing, to prevent relative rotation between the reservoir and the well 66.

The lower part of upstanding portion 68 is hollow, and internally fluted, to engage with respective external flutes on positioning member 70. The fluted member 70 can be positioned adjustably in relation to the base 10 by way of headed bolt 80 which projects through slot 14 in base 10. Thus the well 66 can be adjustably positioned rotatably relative to base 10.

Figure 2:
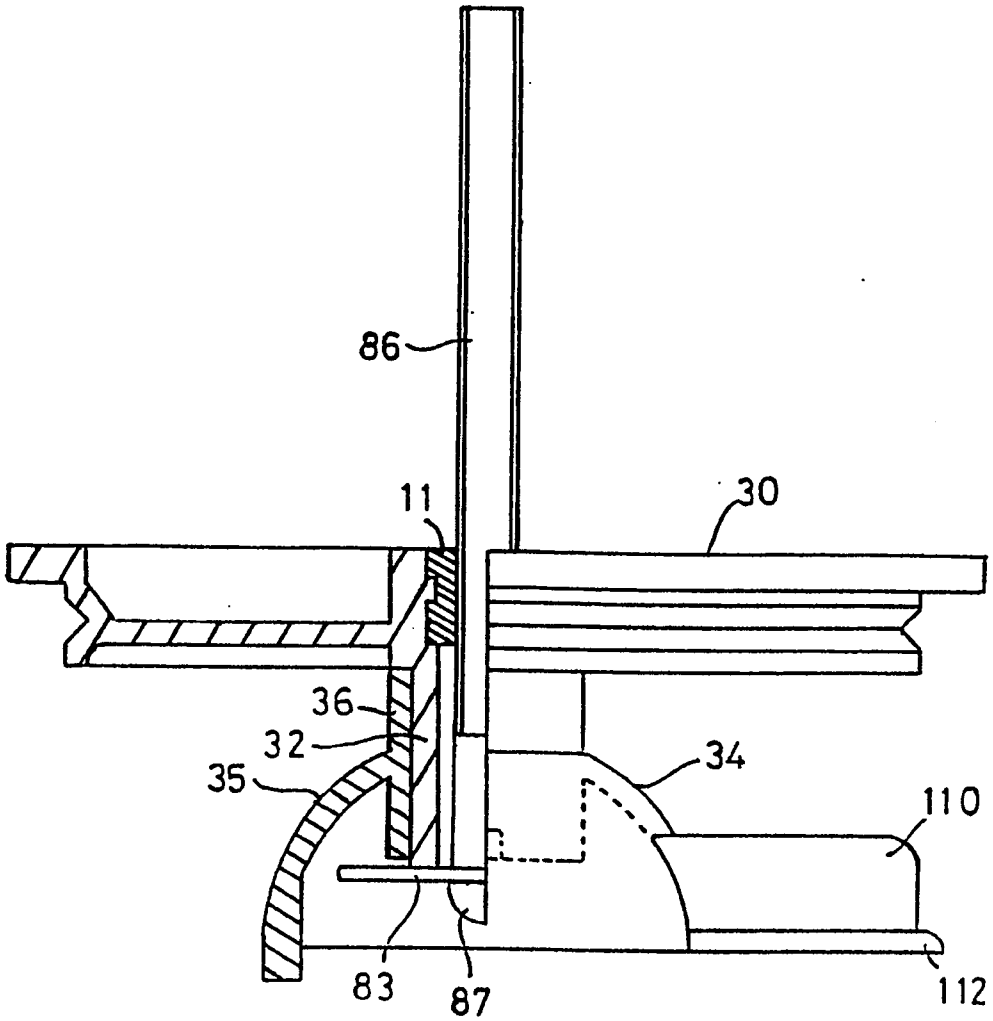
FIG. 2 is a side view, partly in section, of a second or drive platter, fitted for use on a base adapter.

As shown in FIG. 2, the annular housing portion 36 of base adapter 34 extends inwardly of domed base adapter portion 35 to provide respective lateral and vertical location means for each platter and for the drive shaft. The base adapter 24, and the base adapter locating the drive shaft 40, are similarly formed.

Figure 4:
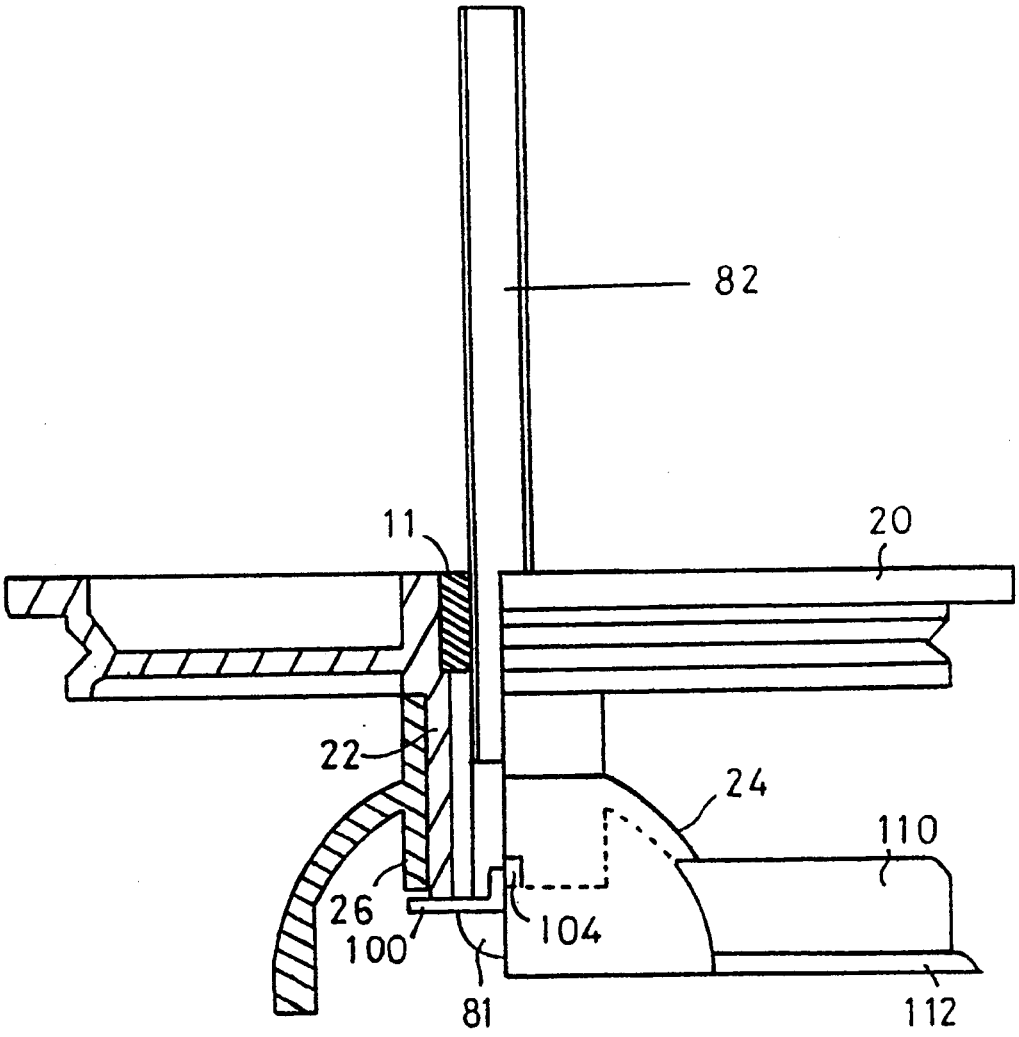
FIG. 4 is a side view, partly in section, of a first platter fitted for use on a base adapter.
Figure 5:
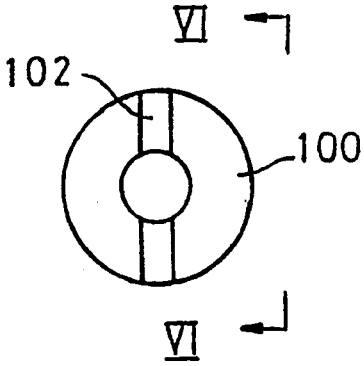
FIG. 5 is a plan view of a lock washer.
Figure 6:
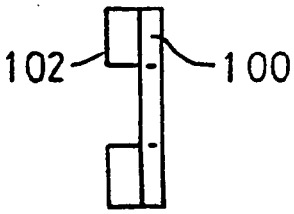
FIG. 6 is a view on the line VI—VI of FIG. 5.

First platter 20 (FIG. 4) mounts first spool 90, which is located by bolt 82 having head 81, with spindle 22 in engagement with annular housing portion 26 of base adapter 24. Lock washer 100 is located between bolt head 81, and base adapter 24, and is engaged in recesses 104 of base adapter 24. Thus in this embodiment bolt 82, by way of lock washer 100 fitting into recess 104, locks first platter 20 to base adapter 24, so that first platter 20 cannot rotate relative thereto. When first spool 90 is rotated, by ribbon 94 being wound onto second spool 92, fixed first platter 20 acts as a friction brake, maintaining tension on the unsupported length R of the ribbon 94.

In an alternative, less preferred, embodiment lock washer 104 is omitted, and replaced by a plain washer, so that first platter 20 may rotate with first spool 90, with some frictional resistance from engagement of spindle 22 with annular housing portion 26, of less (vertical) length for substantially unrestrained rotation.

Second platter 30 is not locked to base adapter 34, but can rotate with its spindle 32 within annular housing portion 36 of base adaptor 34. Bolt 86 is threadedly engaged with brass insert 11, with spindle 32 held tightly against washer 83, so ensuring that the bolt 86 and second platter 30 rotate together. Bolt 86 is of a length to extend upwardly beyond second platter 30, to permit second spool 92 to be slid into position, over the free end of bolt 86. Nut 88 is thereafter tightened on the free end of bolt 86 and into engagement the second spool 92 via washer 89, whereby second spool 92 can be held tightly against second or drive platter 30 and thus be frictionally coupled thereto to rotate therewith. Thus bolt 86, nut 88, brass insert 11, washers 83 and 89, second platter 30 and second spool 92 rotate together, driven by belt 12.

Drive shaft 40 has downwardly depending fingers 41, with outward ridge 43 (FIG. 3).

Figure 7:
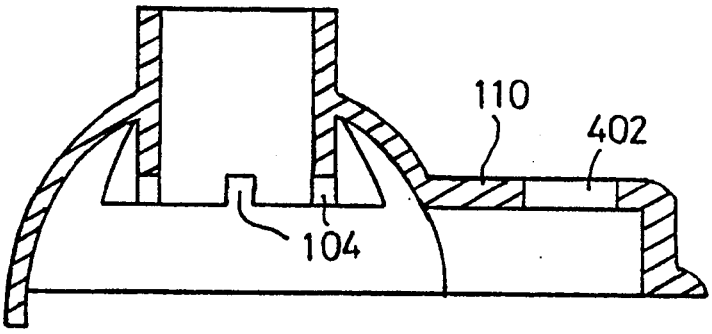
FIG. 7 is a side section view of a base adapter.
Figure 8:
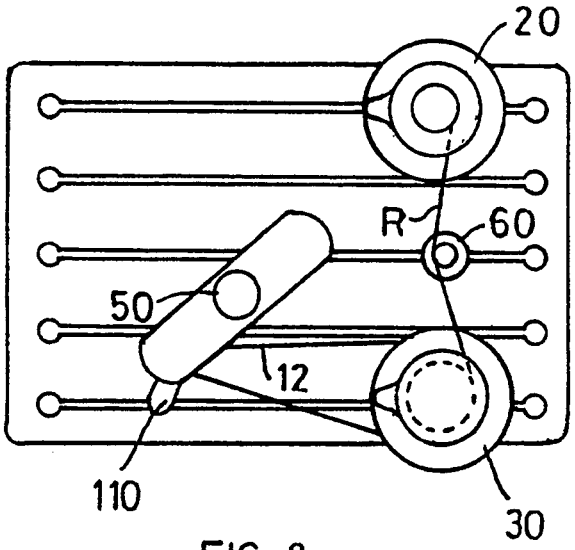
FIG. 8 is a plan view of the device of FIG. 1, in use.

Each base adapter has a transverse extension 110 above a platform 112, the extension 110 having an opening 402 (FIG. 7) to receive bolt 114 having head 116. Thus bolt head 114 is below the base 10 whilst the bolt stem extends through a slot 14, and through the extension 110 (see particularly FIG. 7). After the base adapter has been positioned along the slot and swung to a selected angle relative to the base 10, nut 118 (FIG. 1) is tightened to hold the base adaptor in engagement with base 10 by way of platform 112. Thus the base adapters can be positioned suitably, appropriately for the unsupported ribbon length R extending between first spool 90 and second spool 92, with (at least) part of this unsupported ribbon length in contact with one or more of the reservoir apertures 64. It will be understood that the reservoir 60 is similarly adjustable in position along a slot 14, usually a different slot 14.

In use, the exposed (second) terminal end 93 of the ribbon 94 to be re-inked is coupled to the second spool 92, and can then be wound from first spool 90 onto second spool 92, at a speed determined by motor 50, and the transmission provided by pulley 48, belt 12, and groove 30. Winding can continue (a) for a known time period, sufficient for the first terminal ribbon end (not shown) to release from first spool 90, or (b) if the first ribbon end is locked (in some embodiments temporarily) to first spool 90 then until the second spool is held by ribbon length R against rotation (with perhaps consequent automatic cut-off of the power supply to motor 50 or of the drive connection therefrom).

The ink will be deposited upon ribbon 94 as one or more parallel lines, but will steadily permeate by capillary action through the full ribbon width, if the spool is left for a few hours before use. Thereafter, the second spool can be used in the office equipment, and thus become the first spool; alternatively, the ribbon can be rewound onto the first spool 90, so that second spool 92 remains as the recipient spool on the device, perhaps without need to remove spool 92 from engagement with second drive platter 38.

I claim:

1. A device for inking a fabric ribbon comprising:

a base having a first side and a second side;

a first base adapter;

a second base adapter;

first holding means for releasably mounting the first base adapter to the first side of the base;

second holding means for releasably mounting the second base adapter to the first side of the base;

the first base adapter having a first hollow housing portion spaced from the base;

the second base adapter having a second hollow housing portion spaced from the base;

a first platter;

a first platter spindle extending from the first platter into the first hollow housing portion;

a second platter;

a second platter spindle extending from the second platter into the second hollow housing portion;

first coupling means for connecting the first platter to the first base adapter, the first coupling means having an adapter/spindle part within the first platter spindle, and an opposed spool part projecting from the first platter for mounting a spool;

second coupling means for connecting the second platter to the second base adapter, the second coupling means having an adapter/spindle part within the second platter spindle, and an opposed spool part projecting from the second platter for mounting a spool;

drive means for driving the second platter, the drive means being mounted to the first side of the base;

ink reservoir means for transferring ink to a ribbon, the ink reservoir means being mounted to the first side of the base, the ink reservoir means being positioned on the base so that, when the device is in use, the ink reservoir means will transfer ink to the free run length of ribbon extending from a spool held on the adapter/spindle part of the first coupling means to a spool held on the adapter/spindle part of the second coupling means.

2. The device of claim 1, wherein the first and second base adapters and the ink reservoir means are mounted to the base so that, when the device is in use, the free run length in nonlinear.

3. The device of claim 1, wherein the end portion of the opposed spool part of the second coupling means has a threaded length; and further comprising a nut for threading on the threaded length for clamping a spool to the second platter.

4. The device of claim 1, further comprising means for tensioning the free run length of ribbon without bearing upon the ribbon.

5. The device of claim 1, further comprising locking means for preventing rotation of the first platter.

6. The device of claim 1, wherein the drive means comprises an electric motor mounted on the first side of the base, the motor having an output shaft, a drive pulley connected to the output shaft, wherein the second platter has a peripheral grove, and an endless drive belt connected to the drive pulley and the peripheral grove.

7. The device of claim 6, wherein the peripheral grove is a larger diameter than the drive pulley.

8. The device of claim 1, wherein the second coupling means is also for rotatably connecting the second platter to the second base adapter.

9. The device of claim 1, wherein ink reservoir means comprises a plurality of ink dispensing orifices each at a different distance from the base.

10. The device of claim 1, wherein the ink reservoir means is releasably mounted to the first side of the base.

11. The device of claim 1, further comprising an overflow well mounted to the first side of the base.

12. The device of claim 1, wherein the ink reservoir means comprises an ink reservoir part and an overflow well part which is releasably mounted to the first side of the base, and wherein the ink reservoir part is non-rotatably mounted to the overflow well part.

13. The device of claim 1, wherein the drive means is releasably mounted to the first side of the base by a third holding means, wherein the ink reservoir means is releasably mounted to the first side of the base by a fourth holding means, wherein the base has means for mounting the first, second, third and fourth holding means in several locations on the base.

14. The device of claim 13, wherein the means for mounting the first, second, third and fourth holding means in several locations on the base comprises a plurality of slots through the base, through which the first, second, third and fourth holding means extend.

15. The device of claim 13, further comprising a box having a plurality of chambers, the chambers being adaptable for storing the first and second base adapter, the first and second holding means, the first and second platter, the first and second coupling means, the drive means, and the ink reservoir means; and wherein the base is also a closure for the box.

16. The device of claim 1, further comprising means for causing a spool positioned on the adapter/spindle part of the second coupling means to rotate with the second platter.

17. A device for inking a fabric ribbon comprising:

a base having a first side and a second side;

a first base adapter, and first holding means for releasably mounting the first base adapter to the first side of the base, the first base adapter having a first hollow housing portion spaced from the base;

a first platter, and a first platter spindle extending from the first platter into the first hollow housing portion;

first coupling means for connecting the first platter to the first base adapter, the first coupling means having an adapter/spindle part within the first platter spindle, and an opposed spool part projecting from the first platter for mounting a spool;

a second base adapter, and second holding means for releasably mounting the second base adapter to the first side of the base, the second base adapter having a second hollow housing portion spaced from the base;

a second platter, and a second platter spindle extending from the second platter into the second hollow housing portion;

second coupling means for connecting the second platter to the second base adapter, the second coupling means having an adapter/spindle part within the second platter spindle, and an opposed spool part projecting from the second platter for mounting a spool;

drive means for driving the second platter;

third holding means for releasably mounting the drive means to the first side of the base;

ink reservoir means for transferring ink to a ribbon;

fourth holding means for releasably mounting the ink reservoir means to the first side of the base, the ink reservoir means being positioned on the base so that, when the device is in use, the ink reservoir means will transfer ink to the free run length of ribbon extending from a spool held on the adapter/spindle part of the first coupling means to a spool held on the adapter/spindle part of the second coupling means; and a box having a plurality of chambers, the chambers being adaptable for storing the first and second base adapters, the first, second, third and fourth holding means, the first and second platters, the first and second coupling means, the drive means, and the ink reservoir means; and wherein the base is also a closure for the box.

18. The device of claim 17, wherein the drive means comprises an electric motor mounted on the first side of the base, the motor having an output shaft, a drive pulley connected to the output shaft, wherein the second platter has a peripheral grove, and an endless drive belt connected to the drive pulley and the peripheral grove, and the peripheral grove is a larger diameter than the drive pulley.

* * * * *